United States Patent [19]

McCosker

[11] Patent Number: 4,658,840

[45] Date of Patent: Apr. 21, 1987

[54] STRIP FOR FACILITATING THE SELECTIVE COLORING OF HAIR

[76] Inventor: Doris C. McCosker, 872 Victoria, Costa Mesa, Calif. 92662

[21] Appl. No.: 238,752

[22] Filed: Feb. 27, 1981

[51] Int. Cl.[4] ..... A45D 7/00

[52] U.S. Cl. ..... 132/7

[58] Field of Search ..... 132/9, 43 A, 43 R, 40, 132/42, 39, 7

[56] References Cited

U.S. PATENT DOCUMENTS

| | | | |
|---|---|---|---|
| 3,068,874 | 12/1962 | Rapisarda | 132/9 |
| 3,543,770 | 12/1970 | Snidor | 132/7 |
| 3,566,883 | 3/1971 | Hochstadt | 132/9 |
| 3,610,257 | 10/1971 | Hall | 132/9 |
| 3,692,032 | 9/1972 | Regas | 132/9 |
| 3,726,289 | 4/1973 | Thompson | 132/9 |

*Primary Examiner*—Gregory E. McNeill

*Attorney, Agent, or Firm*—Edgar W. Averill, Jr.

[57] ABSTRACT

A strip for facilitating the selective coloring of hair. A thin sheet of flexible elastic plastic material has a plurality of sets of openings. The openings are used to hold strands of hair which, in turn, hold the sheet to the scalp.

6 Claims, 5 Drawing Figures

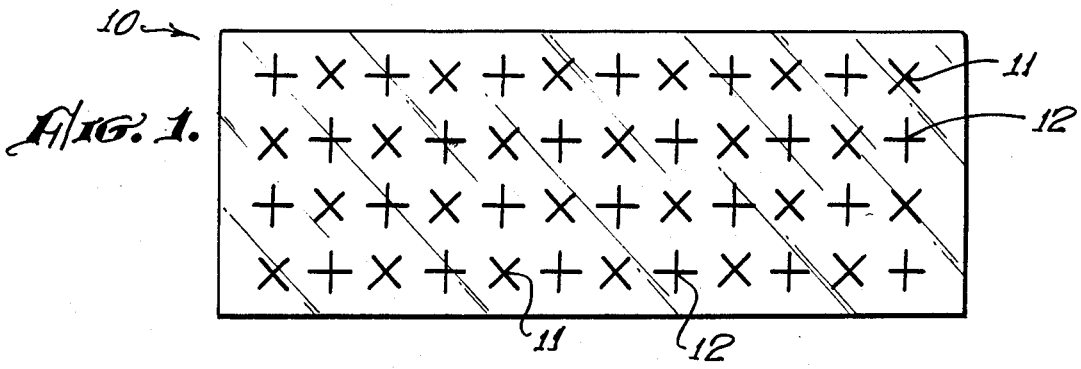
FIG. 1.
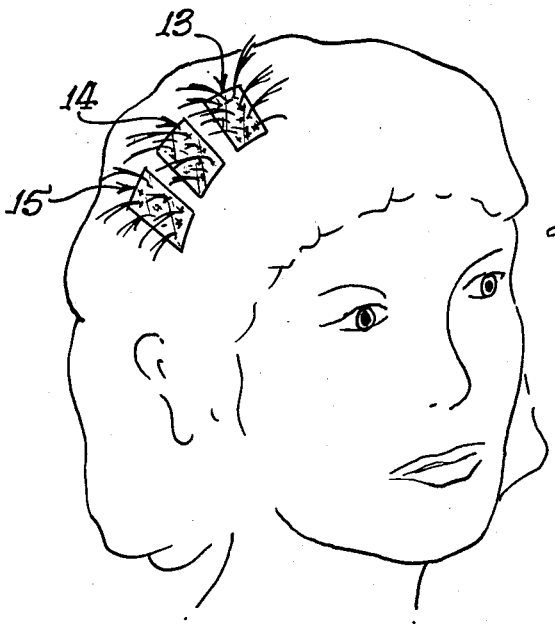
FIG. 2.
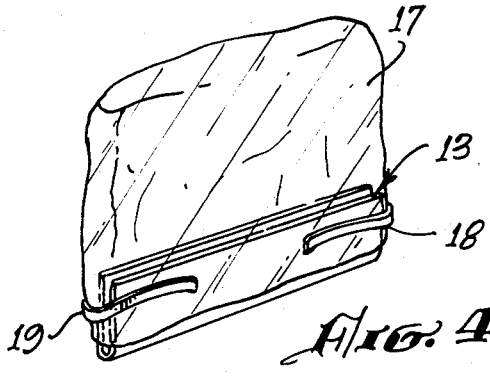
FIG. 4.
FIG. 3.
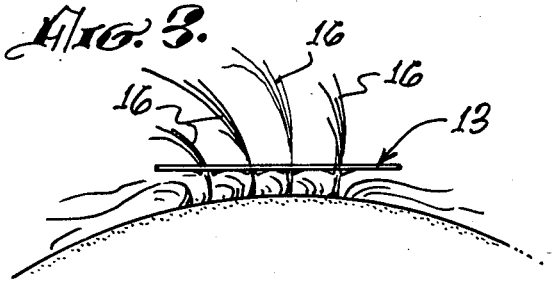
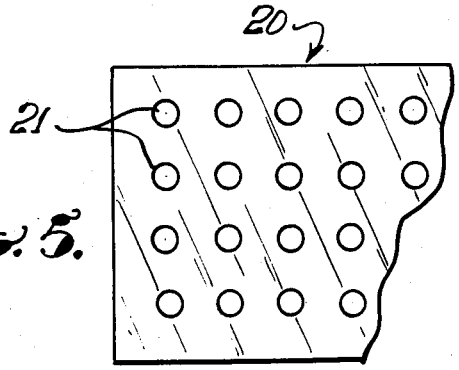
FIG. 5.

STRIP FOR FACILITATING THE SELECTIVE COLORING OF HAIR

BACKGROUND OF THE DISCLOSURE

The field of the invention is hair coloring aids, and the invention more specifically relates to devices for selectively dying or coloring human hair.

In many hair styling operations, it is desired to selectively color a portion of the hair a different color from the rest of the hair. This forms a streaking or highlighted appearance which is desireable.

This streaking or highlighting step has typically been carried out by gathering the appropriate portion of the hair and coating it with the coloring material and wrapping it with aluminum foil. This, however, is not entirely satisfactory since the aluminum foil often slips off the hair. Also, for some frosting operations, a frosting cap is used which comprises a thin plastic cap with a plurality of holes through which the hair is pulled. This approach, however, is uncomfortable to the patron because the cap tends to hold down the hair which is being pulled out through the hole. This is particularly true for longer hair.

There is thus a need for a more comfortable and efficient manner of selectively coloring portions of the hair.

BRIEF SUMMARY OF THE INVENTION

The present invention is for a strip for facilitating the selective coloring of hair. The strip is a thin sheet of flexible elastic plastic material having a plurality of openings formed therein. Strands of hair are pulled through the openings holding the strip to the scalp. In a preferred embodiment, the openings are formed from a plurality of sets of slits. The slits intersect to form closeable openings and the sheet has a plurality of such openings Preferably, the slits are positioned to form alternate x's and +'s. In a preferred embodiment, the strip is covered with a plastic bag which is held to the strip by one or more clips.

BRIEF DESCRIPTION OF THE DRAWINGS

FIG. 1 is a plan view of the strip of the present invention.

FIG. 2 is a perspective view of a plurality of strips installed on a portion of a scalp.

FIG. 3 is an enlarged view of one of the strips shown in FIG. 2.

FIG. 4 is a perspective view of the strip and bag of the present invention.

FIG. 5 is an enlarged view of a portion of the strip of FIG. 1.

DESCRIPTION OF THE PREFERRED EMBODIMENTS

A thin sheet of flexible, elastic, plastic material is shown in FIG. 1 and indicated generally by reference character 10. The strip is fabricated from a plastic such as polyethylene, polypropylene, polyvinyl chloride or the like. The strip should be pliable and elastic, and thickness in the range of about 0.018 to 0.024 inches is appropriate with about 0.020 inches being preferred. Strip 10 has a plurality of x's indicated by reference character 11 and a plurality of +'s indicated by reference character 12. These are slits formed in strip 10 which slits intersect to form an elastic opening which has the ability to hold on to a strand of hair.

In use, one or more strips are placed over the hair to be selectively dyed, and a crochet hook or other pulling device is inserted through one of the openings to pull a strand of hair through the opening. For instance, as shown in FIG. 2, strips 13, 14 and 15 are held to the scalp by a plurality of strands of hair indicated by reference character 16. The strip may be held quite close to the scalp by pushing the strip down while holding the strand 16. This is shown best in FIG. 3.

While the hair may be dyed simply by dying the strands 16, it is preferably enclosed as shown in FIG. 4 by a plastic bag 17 which is held to the strip by plastic clips 18 and 19.

While the x's and +'s shown in FIG. 1 are a preferred shape of opening because of their ability to comfortably hold a strand of hair, other shapes of slits such as a v or c shaped slit could be used. Furthermore, circular openings 21 as shown in sheet 20 in FIG. 5 may be used. The strip can be supplied in a large sheet which may be torn into smaller sheets depending on the particular dying operation desired. Also through the use of the present strip, it is possible to apply another color to the head while that portion pulled through the strip is being bleached or otherwise dyed.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A strip for facilitating the selective coloring of hair, said strip comprising:

a thin sheet of flexible, elastic, plastic material having a thickness between 0.018 and 0.024 inches, said sheet having a plurality of sets of slits formed therein, said slits intersecting to form closeble elastic openings and said sheet having a plurality of such openings.

2. The strip of claim 1 wherein said slits are positioned to form a plurality of alternate x's and +'s.

3. The strip of claim 1 wherein said thin sheet is formed from polyethylene.

4. The strip of claim 1 further including a waterproof bag affixed thereto and surrounding the thin sheet except for a portion of the undersurface adjacent the openings.

5. The strip of claim 4 wherein the bag is affixed to the strip by at least one clip.

6. The stip of claim 1 wherein said thin sheet has a thickness of about 0.020 inches.

* * * * *